US005110083A

United States Patent [19]

Page

[11] Patent Number: 5,110,083

[45] Date of Patent: May 5, 1992

[54] ROSS STAGING BRACKET

[76] Inventor: Ross C. Page, HCR 30 Box 14, East Peacham, Vt. 05862

[21] Appl. No.: 640,106

[22] Filed: Jan. 11, 1991

[51] Int. Cl.[5] ..... E04G 17/06

[52] U.S. Cl. ..... 249/46; 182/82; 248/227; 248/231.3; 248/235; 249/190; 249/213; 249/219.1; 249/219.2

[58] Field of Search ..... 249/46, 213, 219.1, 249/219.2, 190; 248/205, 227, 231.3, 235; 182/82

[56] References Cited

U.S. PATENT DOCUMENTS

| | | | |
|---|---|---|---|
| 2,670,248 | 2/1954 | Heller | 248/235 |
| 3,018,538 | 1/1962 | Gates | 249/219.2 |
| 3,070,337 | 12/1962 | Gates | 249/219.2 |
| 3,175,797 | 3/1965 | Wells | 249/219.2 |
| 3,343,771 | 9/1967 | Gates | 249/219.2 |
| 3,792,831 | 2/1974 | Verhey | 249/219.2 |
| 4,054,259 | 10/1977 | Johnson | 249/219.2 |
| 4,304,388 | 12/1981 | Gates | 249/219.2 |

*Primary Examiner*—Jay H. Woo

*Assistant Examiner*—W. J. Matney, Jr.

*Attorney, Agent, or Firm*—John J. Welch, Jr.

[57] ABSTRACT

A first metal bar having an upwardly extending flange; a second metal bar; a third angulated metal bar or strut; a first horizontal waler support plate; a second vertical form engaging plate extending downwardly from one end of the first horizontal waler support plate, a third vertical waler engaging plate extending upwardly from an opposite end of the first horizontal waler support plate; and, a rotatable cam lock device for engaging with a form tie which device is pivotally mounted to and beneath the first horizontal waler support plate such that the first metal bar is welded to the first horizontal waler support plate with its flange extended upward while that bar extends outward from the first horizontal waler support plate and such that the second metal bar is welded to the second vertical form engaging plate and extends downwardly therefrom, and such that the third angulated metal bar or strut is welded at one end thereof adjacent to an outer end of the first metal bar and is welded at an opposite end thereof adjacent to a lower end of the second metal bar.

1 Claim, 2 Drawing Sheets

ROSS STAGING BRACKET

CROSS REFERENCES TO PRIOR APPLICATIONS

Figure 1:
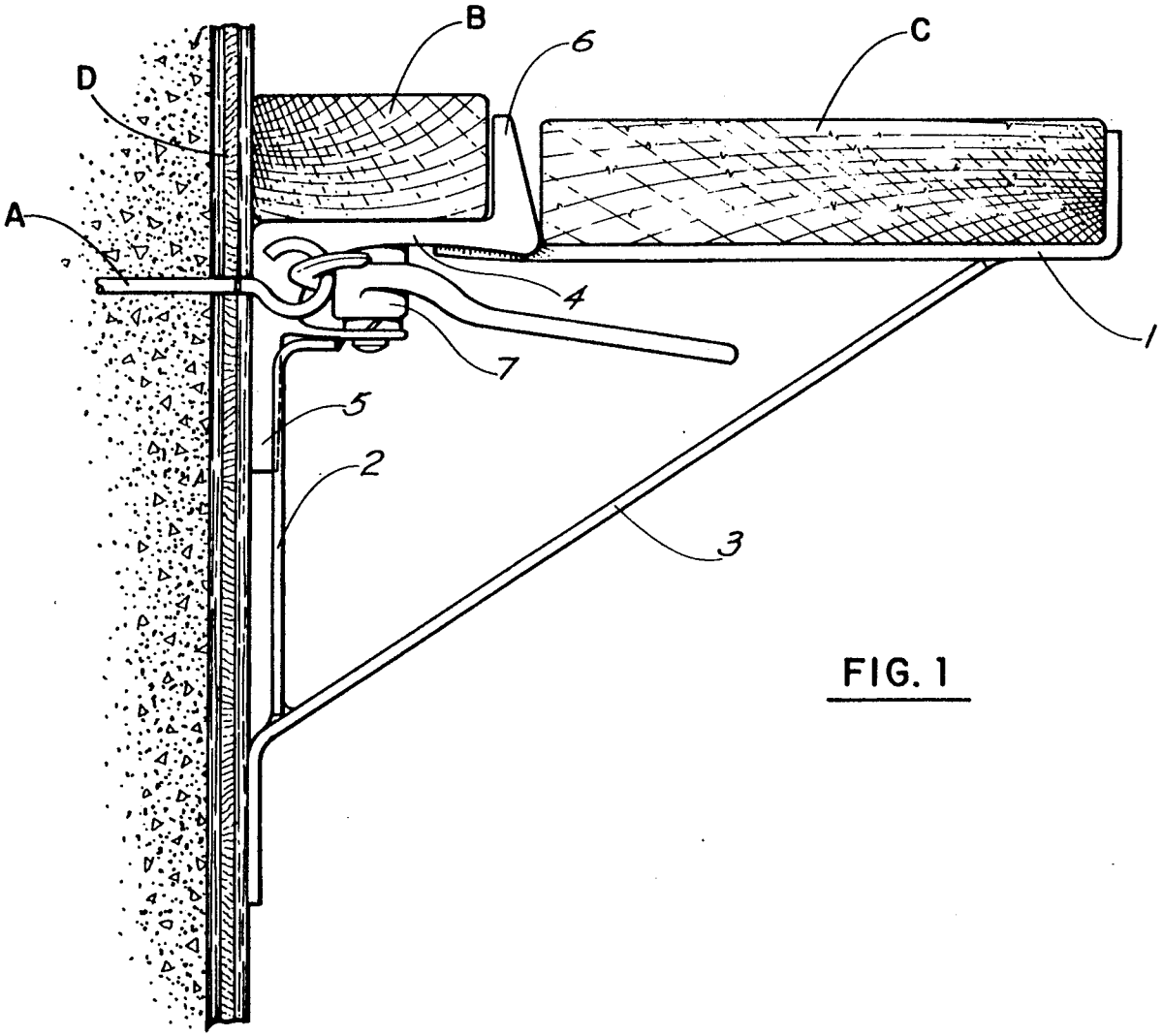

There are no prior or pending applications related to this application.

FEDERALLY SPONSORED RESEARCH AND DEVELOPMENT

There is no involvement with any federally sponsored research and development.

BACKGROUND OF THE INVENTION

1. Field of the Invention

The instant invention is meant to serve two functions simultaneously. It serves as capably as a so-called cam-lock device for purposes of holding heavy duty plywood foundation forming walls or walling (typically 8.5 ft by 2.0 ft by 0.75 ft sections) spaced a foot or so apart in parallel rows in situ for purposes of holding freshly poured concrete for foundations in buildings in place between said sections of walling while it hardens. It also serves to provide a walkway support base for holding planking in place so that workman can readily work on such fresh concrete so poured between the said parallel rows of foundation forming walling sections while such workmen would be standing above ground level on pieces of wooden or metal planking supported by the instant invention.

2. A Description of Possible Background Art a) Please note the existence of a publication entitled: *Gates Cam-Lock Forming System*, copyrighted 1981 by Gates and Sons, Inc., 90 South Fox Street, Denver, Colo., 80233.

b) Please note the following references:

order to keep it smooth. Currently, they can work within such walling by way of resort to expensive rented staging, or by way of staging or scaffolding affixed to such walls in order to be above the tops of such walls at the level of their hips so that they can use devices in their hands to mix and smooth out the concrete therein poured between such walls so as to properly texture or even more importantly to pour such concrete initially between such pieces of walling so set up and to do so in a smooth and uniform manner. In the case of so-called high foundation forming wall panels, to wit, pieces of such walling higher than eight and one-half feet above ground that would be used in respect of the pouring of commercial concrete foundations for tall buildings, scaffolding with fencing guards now currently in vogue is somewhat useful and safe for use to walk about on, notwithstanding its relative lack of economy of manufacture and use as compared to the instant invention. However, with so-called low walls, to wit, foundation forming walling sections less than eight and one-half feet high as would be used for residential concrete foundations, the instant invention is far, far superlative to any such contemporary scaffolding devices from a standpoint of economy of manufacture and maintenance and equals or indeed maybe even surpasses such devices from a safety vantage point. Scaffolding even with fencing is always at risk of collapsing. The highest off the ground that low wall workmen walking about on planking supported by the instant invention would ever be would be five and one-half feet so that their hips would be at the height of the top of such low wall sections. They are at less risk of injury if they fall off a plank walkway onto the ground than if they so fall circumscribed by collapsing staging. Moreover, contemporary scaffolding devices require an elongated stiffback wooden strut such as a piece of 2" by 4" wood

| Inventor | Invention | Patent No. | Date |
|---|---|---|---|
| H. G. Gates | Scaffold Support Bracket | 3,070,337 | Dec. 25, 1962 |
| John Joseph Gavin | Construction Support Means | 3,674,234 | Jul. 4, 1972 |
| H. Gordon Gates | Dual Purpose Form Tie Lock Tool | 4,304,388 | Dec. 8, 1981 |
| O. L. Johnson | Bracket | 980,532 | Jan. 3, 1911 |
| Irvin H. Harris | Apparatus to Facilitate Laying of Bricks | 3,598,352 | Aug. 10, 1971 |
| J. G. W. & C. S. Greives | Carpenter's Bracket | 788,899 | May 2, 1905 |
| Myron B. Verhey | Scaffold-Waler Bracket | 3,792,831 | Feb. 19, 1974 |
| Harry A. Pritchard, Jr. | Scaffold Supporting Waler Bracket | 3,960,355 | Jun. 1, 1976 |
| H. Gordon Gates | Combined Watch Bracket and Cam-Type Latch | 273,932 | May 22, 1984 |
| James C. Shoemaker | Scaffold-Supporting Bracket for a Concrete Wall Form | 3,698,680 | Oct. 17, 1972 |

A SUMMARY OF THE INVENTION

1. The Object of the Invention

The business of laying in concrete foundations is intricate indeed. On the one hand, it is essential to keep two parallel rows of heavy plywood pieces of foundation forming walling firmly in place roughly a foot or so apart so as to prevent the shifting of freshly poured concrete poured between them. Such foundation forming walling pieces must not be permitted to founder or buckle under the pressure of such freshly poured foundation concrete so poured between them. Cam lock devices, so called, serve to accomplish this. On the other hand, workmen are required to guide a pouring gun between such parallel rows of foundation forming walling pieces in order to pour concrete evenly between such pieces of walling. They are also required to work the top layer of such freshly poured concrete in running perpendicular to the base of any such section. They also require ties to hold such struts to such sections as well as ties to hold scaffold brackets to such struts. Thus, contemporary scaffolding consists of a range of parts that are relatively expensive to purchase and maintain as contrasted with the instant invention.

In summary, the instant invention is a new, useful, unique, safe and extremely economical way to not only tightly hold parallel rows of residential foundation forming walling sections in situ spaced a foot or so apart but also to effect the providing of a walkway along the outside of such residential foundation forming walling sections eight and a half feet or less in height for workmen to work on with their hips being at the height of eight and one-half feet off the ground so that their arms are free to do work between such parallel rows of low wall foundation forming wall sections.

2. A Brief Description of the Invention

What is disclosed is a Ross Staging Bracket serving to hold sections of foundation forming walling together in place apart from one another in parallel rows and to support one end of a walkway made of metallic or wooden planking for concrete foundation workman to walk on while pouring and working on fresh concrete held between such parallel sections of foundation forming walling. The invention hereof disclosed is a combination of the following components, to wit: a first metal bar having an upwardly extending flange; a second metal bar; a third angulated metal bar or strut; a first horizontal waler support plate; a second vertical form engaging plate extending downwardly from one end of the first horizontal waler support plate, a third vertical waler engaging plate extending upwardly from an opposite end of the first horizontal waler support plate; and, a rotatable cam lock means for engaging with a form tie which cam lock means is pivotally mounted to and beneath the first horizontal waler support plate such that the first metal bar is welded to the first horizontal waler support plate with its flange extended upward while that bar extends outward from the first horizontal waler support plate beyond the plane of the third vertical waler engaging plate and such that the second metal bar is welded to the second vertical form engaging plate and extends downwardly therefrom, and such that the third angulated metal bar or strut is welded at one end thereof adjacent to an outer end of the first metal bar and is welded at an opposite end thereof adjacent to a lower end of the second metal bar.

A DESCRIPTION OF THE DRAWINGS

FIG. 1 is a side view of the invention showing all of its component parts as its cam lock means component grips a form tie thereby serving to hold the invention firm and flush to a section of foundation forming walling. A waler and planking as cut cross sectionally and held in situ by the invention's first horizontal waler support plate and first metal bar are also shown.

Figure 2:
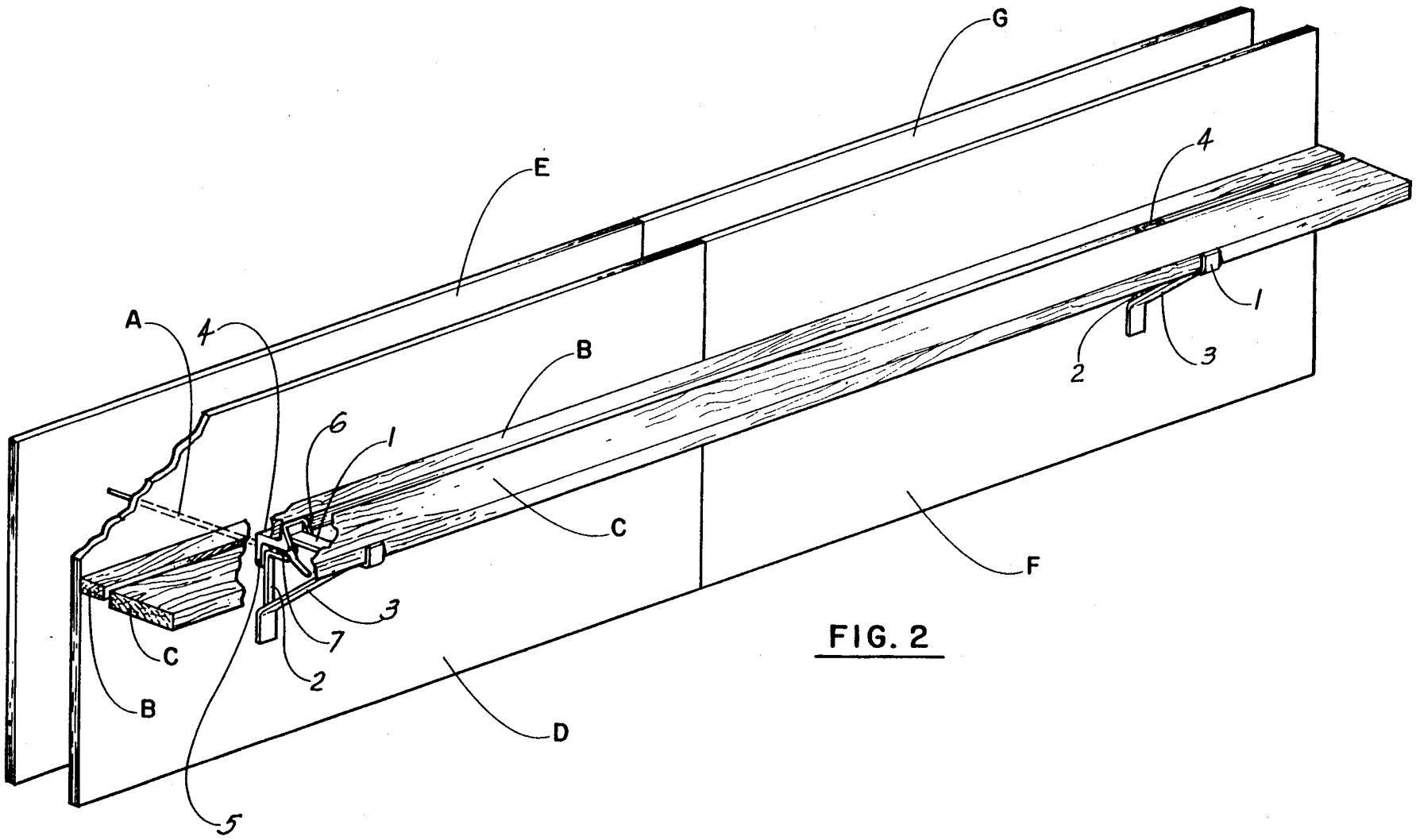

FIG. 2 is a perspective view of two replicas of the invention in place holding two parallel rows of foundation forming walling together as well supporting walkway planking for workmen to stand on. There is further shown therein a cutaway view showing one of the replicas of the invention with all of its component parts as connected to a form tie serving to thereby facilitate holding of such parallel rows of foundation forming walling together.

A DESCRIPTION OF THE PREFERRED EMBODIMENT

With resort to FIG. 1 of the drawings as herewith provided, what follows is a description of the preferred embodiment of the instant invention. The instant invention consists of a first horizontal waler support plate 4, a second vertical form engaging plate 5 extending downwardly from one end of the first horizontal waler support plate 4 and a third vertical waler engaging plate 6 extending upwardly from an opposite end of the first horizontal waler support plate. It moreover consists of rotatable cam lock means 7 for engaging with a form tie A which rotatable cam lock means is pivotally mounted to and beneath the first horizontal waler support plate. It furthermore consists of a first metal bar 1 which is welded to the first horizontal waler support plate 4 such that an outer flange of the first metal bar 1 extends upward as the first metal bar 1 extends outward from the first horizontal waler support plate 4. It, likewise consists of a second metal bar 2 which is welded to the second vertical form engaging plate 5 such that it extends downwardly therefrom. Also, it consists of a third metal bar or strut 3 which is welded at one end thereof to an outer end of the first metal bar 1 and further welded at an opposite end thereof to a lower end of the second metal bar 2. Finally, waler B shown as cut cross-sectionally in FIG. 1 rests against a section of foundation forming walling D on top of the first horizontal waler support plate 4 and likewise against the third vertical waler engaging plate 6 while as well planking C shown as cut cross-sectionally in FIG. 1 rests against the side of the third vertical waler engaging plate 6 opposite to the side of that plate 6 rested against by waler B while likewise resting on and on top of the first metal bar 1 extending outwardly from the first horizontal waler support plate 4 and further concomitantly resting against the upwardly extending flange of the first metal bar 1.

With respect to FIG. 2 of the drawings as herewith provided, there can be seen sections of foundation forming walling D, E, F and G in parallel rows with sections D and E shown held in situ by form tie A as depicted in a cutaway portion of FIG. 2. The first metal bar 1 welded to the first horizontal waler support plate 4 is shown in this cutaway portion supporting planking C between one side of the third vertical waler engaging plate 6 and the upwardly extending flange of the first metal bar 1. Also, the rotable cam lock means 7 is likewise there shown holding form tie A. Also, waler B is likewise there shown supported on top of the first horizontal waler support plate 4 and between a section D of foundation forming walling and the third vertical waler engaging plate 6. Finally, there likewise shown is the second vertical form engaging plate 5 resting against section D and the second metal bar 2 welded thereto and extending downward therefrom which second metal bar 2 is shown as welded to the third angulated bar or strut 3.

Hence, the instant invention as depicted above is shown as serving to not only hold parallel sections of foundation forming walling apart in situ in parallel rows but also to support a walkway made of planking for concrete foundation workmen to walk on while pouring and working on fresh concrete held between such parallel rows of foundation forming walling.

What is claimed is:

1. A Ross Staging Bracket to hold parallel sections of foundation forming walling eight and one-half feet or less in height together in place apart from one another in parallel rows and to support one end of a walkway made of metallic or wooden planking for concrete foundation workmen to walk on while pouring and working on fresh concrete held between such parallel sections of foundation forming walling, comprising:

a. A first bar having an outer upwardly extending flange;
b. A second bar;
c. A third angulated bar or strut;
d. A first horizontal waler support plate;
e. A second vertical form engaging plate extending downwardly from one end of said first horizontal waler support plate;
f. A third vertical waler engaging plate extending upwardly from an opposite end of said first horizontal waler support plate;

g. a rotatable cam lock means for engaging with a form tie, said means being pivotally mounted to and beneath said first horizontal waler support plate such that said first bar having an outer upwardly extending flange is welded to said first horizontal waler support plate and extends outwardly therefrom, and such that said second bar is welded to said second vertical form engaging plate and extends downwardly therefrom and such that said third angulated bar or strut is welded at one end thereof adjacent to an outer end of said first bar and is welded at an opposite end thereof adjacent to a lower end of said second bar.

* * * * *